United States Patent [19]

Daponte

[11] Patent Number: 4,803,117

[45] Date of Patent: Feb. 7, 1989

[54] COFORMED ETHYLENE-VINYL COPOLYMER ELASTOMERIC FIBROUS WEBS

[75] Inventor: Diego H. Daponte, Woodstock, Ga.

[73] Assignee: Kimberly-Clark Corporation, Neenah, Wis.

[21] Appl. No.: 25,557

[22] Filed: Mar. 13, 1987

Related U.S. Application Data

[63] Continuation-in-part of Ser. No. 843,427, Mar. 24, 1986, abandoned.

[51] Int. Cl.[4] ..... D04H 1/58

[52] U.S. Cl. ..... 428/228; 428/247; 428/326; 428/903

[58] Field of Search ..... 428/288, 297, 326, 903

[56] References Cited

U.S. PATENT DOCUMENTS

| | | | |
|---|---|---|---|
| 3,849,241 | 11/1914 | Butin | 264/210 F |
| 4,100,324 | 7/1978 | Anderson | 428/288 |
| 4,181,762 | 1/1980 | Benedyk | 428/97 |
| 4,305,990 | 12/1981 | Kelly | 428/220 |
| 4,323,534 | 4/1982 | Des Marais | 264/211 |
| 4,355,425 | 10/1982 | Jones | 2/402 |
| 4,375,446 | 3/1983 | Fujii | 264/518 |
| 4,413,623 | 11/1983 | Pieniak | 604/365 |
| 4,434,205 | 2/1984 | Fujii | 428/218 |
| 4,450,026 | 5/1984 | Pieniak | 156/164 |
| 4,476,180 | 10/1984 | Wnak | 428/220 |
| 4,508,113 | 4/1985 | Malaney | 128/1320 |
| 4,552,603 | 11/1985 | Harris | 156/157 |
| 4,555,811 | 12/1985 | Shimalla | 2/51 |
| 4,588,630 | 5/1986 | Shimalla | 428/131 |
| 4,741,944 | 5/1988 | Jackson | 428/152 |

FOREIGN PATENT DOCUMENTS 199531 10/1986 European Pat. Off. .

OTHER PUBLICATIONS

Shell Chemical Company Technical Bulletin SC:198-83, pp. 1-6, 9-20.

Shell Chemical Company Technical Bulletin SC:165-77, pp. 1-6.

"Superfine Thermoplastic Fibers," Industrial and Engineering Chemistry, vol. 48, No. 8, pp. 1342-1346.

Naval Research Laboratory Report 111437, Apr. 15, 1954.

Tappi, The Journal of the Technical Association of The Pulp and Paper Industry, vol. 56, pp. 74-77 (Apr. 1973).

Textile World, Feb. 1979, pp. 83-84.

"A Systems Approach to Nonwovens Production" by W. John McCulloch and F. J. Steinlinger Pages 7 and 13.

"Eva and E-Ma Melt Blown Webs ad Elastic and Adhesive Structural Components" C. R. Davey—Exxon Chemical Co.

*Primary Examiner*—James J. Bell

*Attorney, Agent, or Firm*—Joseph P. Harps; Karl V. Sidor

[57] ABSTRACT

Elastomeric melt-blown fibers comprising a copolymer of ethylene and at least one vinyl monomer selected from the group including vinyl ester monomers, unsaturated aliphatic monocarboxylic acids and alkyl esters of these monocarboxylic acids disclosed. Elastomeric nonwoven webs formed from such fibers are also disclosed.

22 Claims, 3 Drawing Sheets

COFORMED ETHYLENE-VINYL COPOLYMER ELASTOMERIC FIBROUS WEBS

FIELD OF THE INVENTION

This application is a continuation-in-part of application Ser. No. 843,427, filed Mar. 24, 1986 now abandoned.

The field of the present invention generally includes certain extrudable compositions and methods for forming the extrudable compositions into fibers, microfibers and fibrous nonwoven elastomeric webs formed therefrom.

BACKGROUND OF THE INVENTION

Melt-blowing techniques for forming very small diameter fibers, sometimes referred to as melt-blown fibers or microfibers, from thermoplastic resins are well known in the art. For example, the production of fibers by melt-blowing is described in an article entitled "Superfine Thermoplastic Fibers", appearing in *Industrial and Engineering Chemistry,* Vol. 48, No. 8, pages 1342–1346. This article describes work done at the Naval Research Laboratories in Washington, D.C.

Another publication dealing with melt-blowing is *Naval Research Laboratory Report* 111437, dated Apr. 15, 1954. Generally, melt-blowing techniques include heating a thermoplastic fiber-forming resin to a molten state and extruding the molten resin through a plurality of linearly arranged small diameter capillaries that are formed in a die as molten threads. The molten threads exit the die into a high velocity stream of gas, usually air, which may be maintained at an elevated temperature and which serves to attenuate the threads of molten resin to form fibers or, depending upon the degree of attenuation, microfibers having diameters less than the diameters of the capillaries of the die arrangement.

U.S. Pat. No. 3,849,241 to Butin, the disclosure of which is hereby incorporated by reference, discloses the manufacture of nonwoven mats by melt-blowing and describes, at column 4, lines 57 et seq., the formation of melt-blown fibers having diameters of from about 0.5 microns to about 400 microns by extruding degraded fiber-forming molten thermoplastic polymer resins as molten threads into an attenuating gas stream. Also disclosed is the fact that the diameters of the attenuated fibers will decrease as the flow of the attenuating gas through the gas outlets, which are located on either side of the die capillaries, increases. It is also stated that, at low to moderate attenuating gas velocities, the extruded molten threads, even after attenuation by the gas into fibers, remain essentially continuous with little or no fiber breakage and that fibers produced in such an arrangement have diameters of, preferably, from about 8 microns to 50 microns. Prior to extrusion the fiber-forming thermoplastic polymer resins are subjected to controlled thermal and oxidative degradation at temperatures ranging from about 550° F. to about 900° F., that is, from about 288° C. to about 482° C., preferably from about 600° F. to 750° F., that is , from about 316° C. to about 399° C., to effect a requisite degradation of the resin to reduce the viscosity of the fiber-forming resin. Typical fiber-forming thermoplastic resins are listed at column 4, lines 35 et seq. and commercially useful resin throughput rates are stated to be from about 0.07 to 5 grams per minute per die extrusion capillary, preferably at least 1 gram per minute per die extrusion capillary.

Some thermoplastic polymers are amenable to the melt-blowing process, while others do not seem to be. As is reported in Tappi, *The Journal of the Technical Association of the Pulp and Paper Industry,* Vol. 56, pages 74–77 (April 1973), a good deal of work has been done with the melt-blowing of polypropylene. Nonwoven webs made from polypropylene microfibers are said to be soft and drapeable. Other polymers that have been evaluated for use in melt-blowing include polyethylene, nylon 6, nylon 11, certain polycarbonates, polyesters of the kind useful as hot-melt adhesives, polyethylene terephthalate, poly(4-methylpentene-1), poly(tetramethylene terephthalate), and polystyrene. The Tappi article reports the properties of nonwoven webs made from melt-blown fibers of these materials. The article also reports that attempts have been made to melt-blow polysulfone, nylon 4, and polyphenylene oxide, without achieving acceptable operation in short screening trials.

The Tappi article also reports that blends of certain resins can be made up for melt-blowing. Thus, pellets of polypropylene and nylon 6 were mixed together, then melt-blown, to produce webs made from blends of these two materials.

In *Textile World,* February 1979, pages 83–84, there is a list of polymers that have been melt-blown successfully. That list appears to have been copied from the list in the Tappi publication, despite the passage of six years between the two respective publications.

For quite some time those in the art have been attempting to form elastomeric resins into fibrous nonwoven elastomeric webs. In fact, the prior art reveals that experimentation with polystyrene/poly(ethylenebutylene)/polystyrene elastomeric copolymer resins materials has occurred. See, for example, U.S. Pat. No. 4,323,534 to des Marais. Unfortunately, the physical properties of the products obtained by the des Marais process, for example, a nonwoven mat of melt-blown fibers, were apparently unsatisfactory because of the use of a leaching step. See also Jones, U.S. Pat. No. 4,355,425.

SUMMARY OF THE INVENTION

It has now been found that certain copolymers of ethylene can in fact be successfully melt-blown into elastomeric fibers or microfibers by judicious selection of materials and processing conditions. The useful copolymers are those of ethylene with at least one vinyl monomer selected from the group including vinyl ester monomers, unsaturated aliphatic monocarboxylic acids and alkyl esters of these monocarboxylic acids, where the amount of vinyl monomer is sufficient to impart elasticity to the melt-blown fibers. Exemplary copolymers are those of ethylene with vinyl acetate (EVA) having a melt index in the range from 32 to 500 grams per ten minutes, when measured in accordance with ASTM D-1238 at condition E, and including from about 10% by weight to about 50% by weight of vinyl acetate monomer, more specifically from about 18% to about 36% by weight of vinyl acetate monomer, and most specifically from about 26% to about 30% by weight of vinyl acetate monomer.

Other copolymer materials that have been proposed as suitable for use in the practice of the invention include ethylene-ethyl acrylate copolymer, ehtylene-methacrylate copolymer, ethylene-methylmethacrylate copolymer, and similar copolymer materials. In any of these materials, the amount of monomer contained besides ethylene is generally from about 10% to about 50% by weight of the copolymer. Copolymer materials of this type contribute pendent groups to the polyethylene backbone, and it has been observed that about 10% by weight of the component other than ethylene is needed to impart desired elastomeric properties to the products produced.

The elastomeric fibers or microfibers of the present invention can be coformed with one or more type of secondary fibers to form a composite elastomeric web. The secondary fiber may be used in an amount greater than 0% by weight up to about 80% by weight of the composite coformed material. Wood pulp fibers are particularly preferred as a secondary fiber because of low cost, high absorbency and retention of satisfactory tactile properties.

The copolymer may be mixed with another polymeric material to produce an extrudable blend that can be melt-blown to form fibers or microfibers of desired properties and characteristics. Thus, an extrudable blend can be prepared from (a) at least about 10% by weight of a copolymer of ethylene and at least one vinyl monomer selected from the group including vinyl ester monomers, unsaturated aliphatic monocarboxylic acids and alkyl esters of these monocarboxylic acids, wherein the amount of vinyl monomer in the copolymer is sufficient to impart elasticity to the melt-blown fibers and (b) at least one modifying polymer. The modifying polymer is a compatible polymer, which may for example be one formed from a monomer having olefinic unsaturation, and is used in an amount of greater than 0% by weight up to about 90% by weight of the blend.

One of the valuable properties of fibers and microfibers and the nonwoven webs produced in accordance with the invention is that of being elastomeric. Webs produced in accordance with the invention thus are stretchable and recover to substantially their original unstretched dimensions when the stretching force is released. They also become tacky at moderately elevated temperatures and their adhesive properties provide added utility.

Often, the modifying polymer is employed to enhance the extrudability and fiber-forming characteristics of the copolymer. However, it may also be selected because of the properties that it imparts to the fibers, microfibers and/or to the nonwoven web formed from the fibers and/or microfibers.

Webs formed from such fibers or microfibers are tactically acceptable, soft, and cloth-like elastomeric nonwoven fabrics. In some embodiments the fibers or microfibers are formed from an extrudable composition that is a mixture of a copolymer of ethylene and vinyl acetate along with one or more polyolefins. The polyolefin or polyolefins modify the hand of the web so that a web of such material is tactically acceptable, and at the same time, the polyolefin or polyolefins may be present in an amount that does not undesirably affect strength and stretch properties.

The modifying polymer may be a polyolefin selected from the group including at least one polymer selected from the group including polyethylene, polypropylene, polybutene, ethylene copolymers (generally other than those with vinyl acetate), propylene copolymers, butene copolymers or blends of two or more of these materials. If the modifying polymer is polyethylene it may be a linear low density polyethylene.

Other modifying polymers include ABA' block copolymers, where A and A' are each a thermoplastic endblock that includes a styrenic moiety and where B is an elastomeric poly(ethylene-butene) midblock.

The extrudable blend usually includes from at least about 10% by weight of the ethylene/vinyl copolymer and from greater than 0% by weight to about 90% by weight of the modifying polymer. In particular the extrudable blend may include from about 10% by weight to about 95% by weight of ethylene/vinyl copolymer and from about 5% by weight to about 90% by weight of the modifying polymer. For example, the blend may include from about 20% by weight to about 95% by weight of the ethylene/vinyl copolymer and from about 5% by weight to about 80% by weight of the modifying polymer. That is, the blend may include from about 30% by weight to about 90% by weight of the ethylene/vinyl copolymer and from about 10% by weight to about 70% by weight of the modifying polymer. More specifically, the blend may include from about 50% by weight to about 90% by weight of the ethylene/vinyl copolymer and from about 10% by weight to about 50% by weight of the modifying polymer. Even more specifically, the blend may be composed of from at least about 50% by weight to about 70% by weight of the ethylene/vinyl copolymer and from at least about 30% by weight to about 50% by weight of the modifying polymer. One preferred blend includes about 60% by weight of the ethylene/vinyl copolymer and about 40% by weight of the modifying polymer.

The extrudable blend is extruded at an effective combination of elevated pressure and elevated temperature conditions. These conditions will vary depending on the modifying polymer utilized. For example, the extrudable blend should be extruded or otherwise formed at a temperature of at least about 380° F. (193° C.), for example about 460° F. (238° C.), if the extrudable blend includes a copolymer of ethylene and vinyl acetate and the modifying polymer is polyethylene, polypropylene, or a mixture of the two.

The blends are generally extrudable at or above the above-defined temperatures at elevated pressures within the die. For example, within the extrusion capillaries of a die having thirty (30) extrusion capillaries per linear inch of die tip with each of the capillaries having a diameter of 0.0145 inch and a length of 0.113 inch, a pressure of no more than about 300 pounds per square inch, gauge, for example, pressures of from about 20 pounds per square inch, gauge, to about 250 pounds per square inch, gauge, are often adequate. More specifically, the blends are generally extrudable within the above-defined temperature ranges at pressures of from about 50 pounds per square inch, gauge, to about 250 pounds per square inch, gauge, for example, from about 125 pounds per square inch, gauge, to about 225 pounds per square inch, gauge. Higher elevated pressures can be utilized with other die designs having a lower number of capillaries per inch of die, but generally speaking, lower production rates result.

An ethylene vinyl acetate copolymer with a very high melt index and a high content of vinyl acetate can be expected to be very low in viscosity and somewhat difficult to process unless blended with a polyolefin, preferably polypropylene. Thus, when an ethylene vinyl acetate copolymer is to be melt-blown without inclusion of a modifying polymer, generally the selection of an ethylene vinyl acetate copolymer having about 21% to 40% by weight vinyl acetate content, and a melt index in the range of from about 100 to 300 grams per ten minutes when measured in accordance with ASTM D-1238, condition E, will facilitate processing. Generally, those skilled in the art will be able to make the necessary adjustments to practice the invention on particular equipment and with particular copolymers or copolymer blends.

It has been found that the extrudable blends of the present invention are usually extrudable at satisfactory throughput rates. Such rates may be attributable to the presence of the modifying polymer additive in the extrudable blend, to form blends of suitable viscosity, where the copolymer is, for example, an ethylene vinyl acetate copolymer having a low melt index and high viscosity. A reduced viscosity proportionally reduces the die pressure if all other parameters remain the same. For example, the viscosity of the extrudable blends should generally be less than about 500 poise when extruded at the above-defined elevated temperature and elevated pressure ranges. Preferably, the viscosity of the extrudale blend is from about 100 poise to about 200 poise when extruded at the above-identified elevated temperature and elevated pressure conditions.

The modifying polymer may reduce or increase the viscosity of the blend, as compared to the viscosity of the copolymer, so that the extrudable blend is extrudable within the above-identified elevated temperature and elevated pressure ranges. Reduction or increase will depend on the ethylene/vinyl copolymer and modifying polymer selected for use.

The extrudable blend may be formed into a variety of products such as, for example, fibrous nonwoven elastomeric webs formed from elastomeric microfibers with an average diameter of not greater than about 100 microns, and having an average basis weight of not more than about 300 grams per square meter, or more specifically, an average basis weight of from about 0.5 oz. per square yard to about 100 oz. or more per square yard; for example, an average basis weight of from about 1 ounce per square yard to about 10 ounces per square yard. The fibrous nonwoven elastomeric web may be formed by melt-blowing the extrudable composition at an effective combination of elevated temperature and elevated pressure conditions.

The extrudable blend may be extruded at a rate of from at least about 0.02 gram per capillary per minute to about 1.7 or more grams per capillary per minute, for example, from at least about 0.1 gram per capillary per minute to about 1.25 grams per capillary per minute, more specifically, from at least about 0.3 gram per capillary per minute to about 1.1 grams per capillary per minute, through a die having a plurality of small diameter extrusion capillaries as molten threads into a gas stream which attenuates the molten threads to provide a gas-borne stream of fibers or microfibers. These fibers or microfibers may be collected and formed into a fibrous nonwoven elastomeric web.

The attenuating gas stream may be applied to the molten threads at a temperature of from at least about 250° F. to about 500° F., and preferably from about 280° F. to about 450° F., and at a pressure of from at least about 0.5 pound per square inch, gauge, to about 20 pounds per square inch, gauge, for example, from at least about 1 pound per square inch, gauge, to about 10 pounds per square inch, gauge. The attenuating gas stream may be air or an inert, non-oxidizing gas stream such as, for example, a stream of nitrogen gas. Temperatures above about 450° F. are to be avoided if the ethylene/vinyl copolymer is an ethylene vinyl acetate copolymer which begins to degrade at about 450° F. In some embodiments the velocity and temperature of the thread-attenuating gas stream is adjusted so that the fibers are collected as substantially continuous fibers having diameters of from about ten (10) microns to about sixty (60) microns, for example, from at least about ten (10) microns to about forty (40) microns.

Still other aspects of the present invention will become apparent to thosed skilled in the art upon review of the following detailed disclosure.

DEFINITIONS

The term "copolymer" without any preceding modifying term, is used herein as a form of abbreviation. It refers to a copolymer of ethylene and at least one other vinyl monomer selected from the group consisting of vinyl ester monomers, and unsaturated aliphatic monocarboxylic acids and alkyl esters of said monocarboxylic acids. For the practice of the present invention, the preferred copolymer is a copolymer of ethylene and vinyl acetate having a melt index in the range from 32 to 500 grams per 10 minutes when measured in accordance with ASTM-D 1238, condition E (2,160 gram load at 190° C.) and comprising from about 10% to about 50% by weight of vinyl acetate.

The term "modifying polymer" is employed to refer to a material that is added to the copolymer to modify the properties of the product. Sometimes, the modifying polymer is added for the purpose of reducing viscosity at the extrusion orifices, that is, at the capillaries in the die head. More generally, however, the modifying polymer may be added to impart unique attributes to fibers or microfibers formed from the blend, or to enhance one or more desirable properties already present.

The term "compatible" is used to refer to the relationship of one polymeric material to another with respect to the extrusion process and extrudates. To be compatible, two different polymeric materials must have similar rheological behavior, they must form a generally homogeneous melt. A compatible polymer is one which when mixed with the copolymer and subjected to an effective combination of elevated temperature and elevated pressure conditions can be extruded and melt-blown to form fibers or microfibers.

The term "coforming" is well understood in the art. It is used to refer to the incorporation of at least one type of secondary fibrous material into a stream of fibers or microfibers. The fibers or microfibers may still be tacky or molten, so that upon contact, the secondary fibers bond to the fibers or microfibers or the fibers or microfibers may be completely cooled so that joining of the secondary fibers to the elastomeric fibers or microfibers is limited to physical entangling.

The terms "elastic" and "elastomeric" are used interchangeably herein to define any material that, upon application of a biasing force, is stretchable to a stretched, biased elongated length which is at least about 125 percent, that is about one and one-quarter times, its relaxed, unbiased length, and which will recover at least 40 percent of its elongation upon release of the stretching, elongating force. A hypothetical example which would satisfy this definition of an elastomeric material would be a one (1) inch sample of a material which is elongatable to at least 1.25 inches and which, upon being elongated to 1.25 inches and released, will recover to a length of not more than 1.15 inches. Many elastic materials may be stretched by much more than 25 percent of their relaxed length and many of these will recover to substantially their original relaxed length upon release of the stretching, elongating force. This latter class of materials is generally preferred for purpose of the present invention.

The term "melt flow" as used herein is the amount (usually in grams per 10 minutes or decigrams per minute) of a material which can be forced through a given orifice under a specified pressure and at a given temperature. The value should be determined in accordance with ASTM D 1238. The term "melt index" refers to the value obtained in accordance with condition E of ASTM D 1238 (190° C. and 2,160 gram load) and modified as follows:

(1) If the melt index (MI) at condition E is less than 100 grams per 10 minutes the melt flow rate (MFR) in accordance with ASTM D 1238 at 125° C. and 2,160 gram load is determined and the reported melt index is determined by the following equation:

$$MI = 8.7 \times (MFR)^{0.917}$$

(2) If the melt index (MI) at condition E is greater than 100 grams per 10 minutes the melt flow rate (MFR) in accordance with ASTM D 1238 at 125° C. and 325 gram weight is determined and the reported melt index is determined by the following equation:

$$MI = 66.8 \times (MFR)^{0.83}$$

As used herin, the term "recover" refers to a contraction of a stretched material upon termination of a biasing force following stretching of the material by application of the biasing force. For example, if a material having a relaxed, unbiased length of one (1) inch were elongated 50% by stretching to a length of one and one-half (1.5) inches, the material would have been elongated 50% and would have a stretched length that is 150% of its relaxed length. If this exemplary stretched material contracted, that is, recovered to a length of one and one-tenth (1.1) inches after release of the biasing and stretching force, the material would have recovered 80 percent (0.4 inch) of its elongation.

The term "microfibers" is used herein to refer to small diameter fibers having an average diameter not greater than about 100 microns. For example, having an average diameter in the range from about 0.5 micron to about 50 microns, more specifically having an average diameter of from about 4 microns to about 40 microns.

As used herein, the term "nonwoven web" means a web of material which has been formed without the use of a weaving process. A nonwoven web has a structure of individual fibers or threads which are interlaid, but not in an identifiable, repeating manner. Nonwoven webs in the past have been formed by a variety of processes such as, for example, melt-blowing processes, spun-bonding processes and staple fiber carding processes.

Unless specifically set forth and defined or otherwise limited, the terms "polymer" or "polymer resin" as used herein generally include, but are not limited to, homopolymers, copolymers, such as, for example, block, graft, random and alternating copolymers, terpolymers, etc., and blends and modifications thereof. Furthermore, unless otherwise specifically limited, the term "polymer" or "polymer resin" shall include all possible geometrical, i.e., stereo configurations of the material. These configurations include, but are not limited to, isotactic, syndiotactic and random symmetries.

As used herein, an "inert" attenuating gas is a nonoxidizing gas which does not degrade the material being melt-blown.

As used herein, the term "consisting essentially of" does not exclude the presence of additional materials which do not significantly affect the elastic properties and characteristics of a given polymeric composition. Exemplary materials of this sort would include, without limitation, pigments, antioxidants, stabilizers, surfactants, waxes, flow promoters, solid solvents, particulates and materials added to enhance processability of the composition.

DETAILED DESCRIPTION

Figure 1:
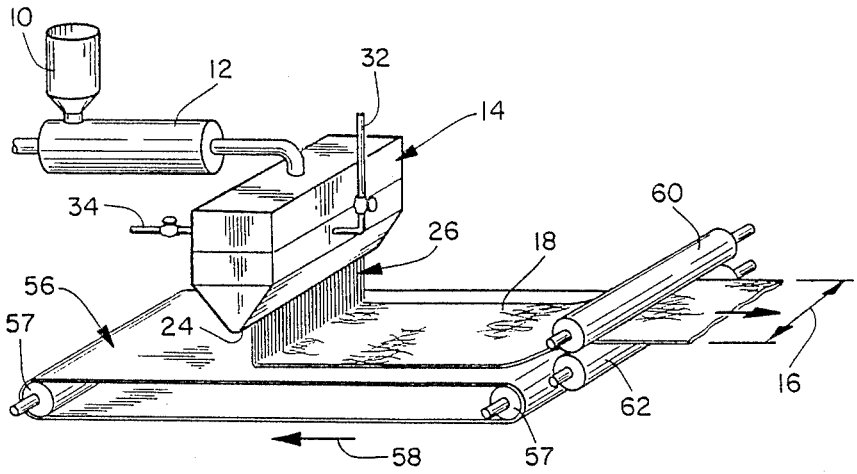
FIG. 1 is a perspective schematic view illustrating one embodiment of a process for forming a nonwoven elastomeric web in accordance with the present invention.

The ethylene/vinyl copolymers of the present invention have broad application in the formation of elastomeric materials such as elastomeric fibers which may be formed into elastomeric webs or other products, by suitable methods such as, for example, extrusion or molding processes. A preferred method for forming the fibers or microfibers is to melt-blow fibers to form a fibrous nonwoven elastomeric web.

Melt-blowing processes generally involve extruding a thermoplastic polymer resin through a plurality of small diameter capillaries of a melt-blowing die as molten threads into a heated gas stream which is flowing generally in the same direction as that of the extruded threads so that the extruded threads are attenuated, i.e., drawn or extended, to reduce their diameters to fiber or microfiber size. The thus-formed fibers are then borne away from the vicinity of the die by the gas stream. The gas stream is directed onto a foraminous member, such as a screen belt or a screen drum which is moving over a vacuum box, so that the gas-borne fibers impinge upon and are collected on the surface of the foraminous member and form a cohesive fibrous nonwoven web.

Melt-blowing dies usually extend across the foraminous collecting member in a direction which is substantially transverse to the direction of movement of the collecting surface. The die includes a plurality of small diameter capillaries arranged linearly along the transverse extent of the die with the transverse extent of the die being approximately as long as the desired width of the fibrous nonwoven web which is to be produced. That is, the transverse dimension of the die is the dimension which is defined by the linear array of die capillaries. Typically, the diameter of the capillaries will be on the order of from about 0.01 inch to about 0.02 inch, for example, from about 0.0145 inch to about 0.018 inch. From about 5 to about 50 such capillaries will be provided per linear inch of die face. Typically, the length of the capillaries will be from about 0.05 inch to about 0.20 inch, for example, about 0.113 inch to about 0.14 inch long. A melt-blowing die can extend from about 30 inches to about 60 or more inches in the transverse direction.

In melt-blowing copolymers of ethylene and vinyl acetate, in the absence of any modifying polymer, a copolymer having a melt index in the range of from about 32 to about 500 grams per ten minutes and comprising from about 10% to about 50% by weight of vinyl acetate may be utilized. However, use of an ethylene vinyl acetate copolymer having a melt index of from about 50 to 300 grams per 10 minutes and from about 21% by weight to about 40% by weight of vinyl acetate monomer is desired for facilitated processing. When the melt index is less than about 32 grams per ten minutes the ethylene-vinyl acetate exhibits a high viscosity during melt-blowing. At a melt index of greater than about 500 grams per ten minutes the copolymer exhibits a very low viscosity during melt-blowing. Generally, the use of a modifying copolymer is not essential for melt-blowing the copolymer. However, at low melt index values, some modifying polymer may be useful for adjusting viscosity values.

Ethylene vinyl acetate copolymers are characterized by both their melt index and their percentage of vinyl acetate. In some cases, a melt index as low as 20 grams per ten minutes probably could be used, but would be expected to require such special precautions and treatment as not to be feasible for commercial processes under present conditions and with existing equipment. Exemplary melt index ranges for the ethylene vinyl acetate copolymer are from about 50 to 200 grams per ten minutes, more specifically from about 150 to 200 grams per ten minutes.

The copolymer is readily commercially available. Generally, the percentage of vinyl acetate in commercial products is from about 6% to about 70%, depending upon the properties desired and the application intended. When the percentage of vinyl acetate is above about 40%, processing is difficult. For developing elastomeric properties in fibers or microfibers, and in nonwoven coherent webs made from these fibers or microfibers, it is believed that the ethylene vinyl acetate copolymer should contain at least about 10% by weight of vinyl acetate monomer. Generally, the vinyl acetate content should not exceed about 50% by weight for present purposes, because at contents above about 50%, the viscosity of the copolymer is very low and processing difficulties are encountered. While the percentage of vinyl acetate therefore may be in the range from about 10% by weight to about 50% by weight, a specific range is 18% by weight to 36% by weight, and a more specific range is about 26% by weight to 30% by weight, with an even more specific value being about 28% by weight.

While the copolymer may be a copolymer of ethylene with vinyl acetate, the invention encompasses other copolymer materials. Thus, it is contemplated that useful melt-blown fibers can be formed from a copolymer of ethylene and at least one vinyl monomer selected from the group including vinyl ester monomers, unsaturated aliphatic monocarboxylic acids and alkyl esters of said monocarboxylic acids, wherein the amount of vinyl monomer in said copolymer is sufficient to impart elasticity to the fibers formed therefrom. Thus, the ethylene/vinyl copolymer embraces a spectrum of materials including the copolymers of ethylene and vinyl acetate, ethylene and ethyl acrylate, ethylene and methyl acrylate, ethylene and methyl methacrylate, and the like. It is also possible to use mixtures of the copolymeric materials to achieve particular properties in the melt-blown fibers and in the webs formed therefrom.

Blending of the copolymer with a modifying polymer is often not necessary for viscosity adjustment purposes. However, when the melt index of the selected copolymer is low, blending may be desirable to facilitate extrusion. Also, blending may be desirable even where not mandated to control viscosity, in order to develop particular properties in the resulting fibers or microfibers. The modifying polymer selected should be one which, when blended with the copolymer, and subjected to an effective combination of elevated temperature and elevated pressure conditions, is adapted to be extruded, in blended form, with the copolymer.

Suitable modifying polymers may be polyolefin materials selected from the group including polypropylene, polyethylene, polybutene, including ethylene copolymers, propylene copolymers and butene copolymers. If the modifying polymer is polyethylene it may be a linear low density polyethylene. Blends of two or more of the polyolefins may be utilized. One polyethylene may be obtained from U.S.I. Chemical Company under the trade designation Petrothene Na601 (also referred to herein as PE Na601). A preferred polyethylene is that used in Example V, below. A preferred polypropylene may be obtained from The Exxon Chemical Co. under the trade designation PP 3145.

Information obtained from U.S.I. Chemical Company states that the Na601 is a low molecular weight, low density polyethylene for application in the areas of hot melt adhesives and coatings. U.S.I. has also stated that the Na601 has the following nominal values: (1) a Brookfield Viscosity, cP at 150° C. of 8500 and at 190° C. of 3300 when measured in accordance with ASTM D 3236; (2) a density of 0.903 grams per cubic centimeter when measured in accordance with ASTM D 1505; (3) an equivalent Melt index of 2000 grams per 10 minutes when measured in accordance with ASTM D 1238; (4) a ring and ball softening point of 102° C. when measured in accordance with ASTM E 28; (5) a tensile of 850 pounds per square inch when measured in accordance with ASTM D 638; (6) an elongation of 90% when measured in accordance with ASTM D 638; (7) a modulus of Rigidity, $T_F$ (45,000) of −34° C. and (8) a penetration Hardness (tenths of mm) of 3.6 at 77° F.

The Na601 is believed to have a number average molecular weight (Mn) of about 4600; a weight average molecular weight (Mw) of about 22,400 and a Z average molecular weight (MZ) of about 83,300. The polydispersity (Mw/Mn) of the Na601 is about 4.87.

Mn is calculated by the formula:

$$Mn = \frac{\text{Sum } [(n)(MW)]}{\text{Sum } (n)}$$

Mw is calculated by the formula:

$$Mw = \frac{\text{Sum } [(n)(MW)^2]}{\text{Sum } [(n)(MW)]}$$

Mz is calculated by the formula:

$$Mz = \frac{\text{Sum } [(n)(MW)^3]}{\text{Sum } [(n)(MW)^2]}$$

where:

MW=the various molecular weights of the individual molecules in a sample, and n=the number of molecules in the given sample which have a given molecular weight of MW.

Typical characteristics of the Exxon PP 3145 polypropylene as stated by Exxon are a density of about 0.910 grams per cubic centimeter measured in accordance with ASTM D 792. A melt-flow rate obtained in accordance with ASTM D 1238, Condition L, of about 300 grams per ten (10) minutes. The PP 3145 is believed to have a number average molecular weight (Mn) of about 43,580; a weight average molecular weight (Mw) of about 124,400 and a Z average weight (Mz) of about 255,600. The polydispersity of the PP 3145 (Mw/Mn) is about 2.85.

The modifying polymer may also be an ABA' block copolymer, for example one of the kind sold under the trademark KRATON G by the Shell Chemical Company. In these ABA' block copolymers, A and A' are each a thermoplastic polymer endblock that includes a styrenic moiety, and B is an elastomeric poly(ethylene-butene) midblock.

Generally, the ABA' block copolymer resin must be one which is free of polymer segments which chain scission or which crosslink at the temperatures utilized by the process of the present invention, because such materials will either tend to plug up the small diameter capillaries through which the molten extrudable composition must be extruded or will degrade and form unsatisfactory product.

The neat copolymer may be extruded through the die capillaries at a temperature of at least about 240° F. If polyethylene and/or polypropylene is utilized as a modifying polymer the blend may be extruded through the die capillaries at a temperature in the range of from at least about 280° F. For example, from about 400° F. to about 500° F.

Specific polyolefin blends with EVA can be briefly summarized, as to proportions, as follows:

| Blends with Polypropylene (%) | Blends with LLD Polyethylene (%) | Blends with Both (%) |
|---|---|---|
| 5 PP/95 EVA | 10 LLD PE/90 EVA | 10 PP/30 LLD PE/60 EVA |
| 20 PP/80 EVA | 30 LLD PE/70 EVA | 15 PP/15 LLD PE/70 EVA |
| 40 PP/60 EVA | 50 LLD PE/50 EVA | 10 PP/10 LLD PE/80 EVA |
| 60 PP/40 EVA | 90 LLD PE/10 EVA | |

Referring now to the drawings where like reference numerals represent like structure or like process steps and, in particular, to FIG. 1 which schematically illustrates apparatus for forming an elastomeric nonwoven web in accordance with the present invention, it can be seen that the ethylene/vinyl copolymer or alternatively an extrudable blend (neither shown) of (a) from at least about 10% by weight of ethylene-vinyl copolymer with (b) from 0% by weight to about 90% by weight of a compatible modifying polymer, for example a polyolefin is supplied in pellet or other convenient form to a hopper 10 of an extruder 12.

The blend, if a blend is employed, usually includes from at least about 10% by weight to about 95% by weight of the copolymer and from about 5% by weight to about 90% by weight of the modifying polymer. For example, the blend may include from about 20% by weight to about 95% by weight of the ethylene/vinyl copolymer and from about 5% by weight to about 80% by weight of the modifying polymer, more specifically from about 30% by weight to about 90% by weight of the ethylene/vinyl copolymer and from about 10% by weight to about 70% by weight of the modifying polymer. Even more specifically, the blend may include from about 50% by weight to about 90% by weight of the ethylene/vinyl copolymer and from about 10% by weight to about 50% by weight of the modifying polymer. More specifically, the blend may include from about 50% by weight to about 70% by weight of the ethylene/vinyl copolymer with from about 30% by weight to about 50% by weight of the modifying polymer. One blend includes about 60% by weight of the ethylene/vinyl copolymer and about 40% by weight of the modifying polymer.

The temperature of the blend is elevated within the extruder 12 by a conventional heating arrangement (not shown) to melt the blend. Pressure is applied to the blend by the pressure-applying action of a turning screw (not shown), located within the extruder, to form the blend into an extrudable composition. Preferably the blend is heated to a temperature of at least about 280° F., for example at least about 400° F., if polyethylene or polypropylene is utilized as the modifying polymer in the blend. The extrudable composition is then forwarded by the pressure applying action of the turning screw to a melt-blowing die 14. The elevated temperature of the extrudable composition is maintained in the melt-blowing die 14 by a conventional heating arrangement (not shown). The die 14 generally extends a distance about equal to the width 16 of the nonwoven web 18 which is to be formed by the process. The combination of elevated temperature and elevated pressure conditions which effect extrusion of the composition will vary over wide ranges. For example, at higher elevated temperatures, lower elevated pressures will result in satisfactory extrusion rates and, at higher elevated pressures of extrusion, lower elevated temperatures will effect satisfactory extrusion rates.

Figure 2:
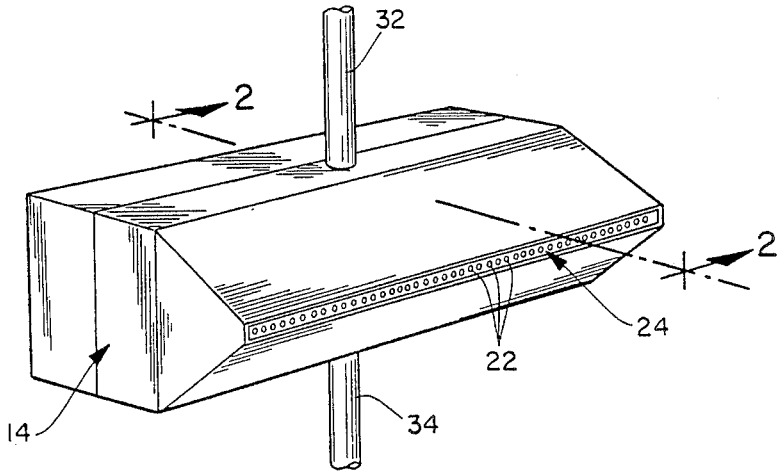
FIG. 2 is a perspective view, on an enlarged scale, of the melt-blowing die illustrated in FIG. 1 which illustrates the linear arrangement of the capillaries of the die.
Figure 4:
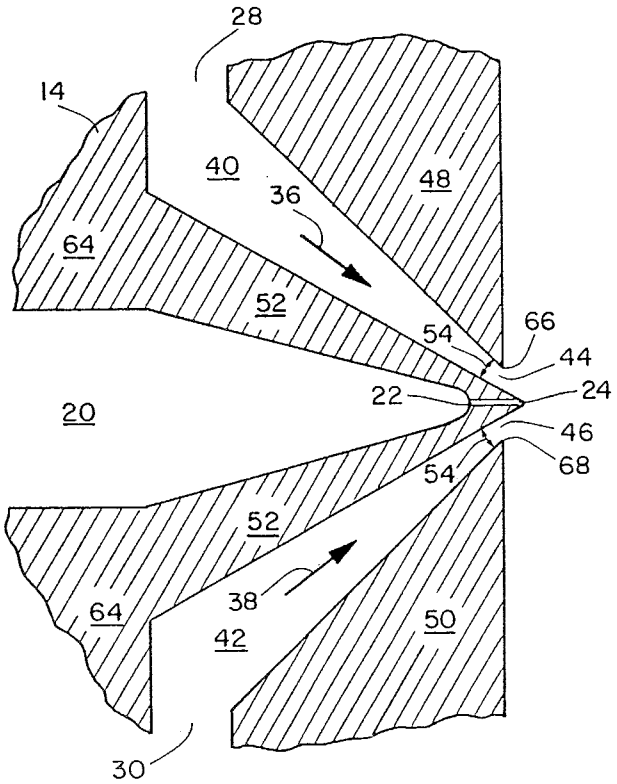
FIG. 4 is another schematic cross-sectional view of the die illustrated in FIG. 1, taken along line 2—2 of FIG. 2, illustrating the die in a positive die tip stick-out arrangement.
Figure 3:
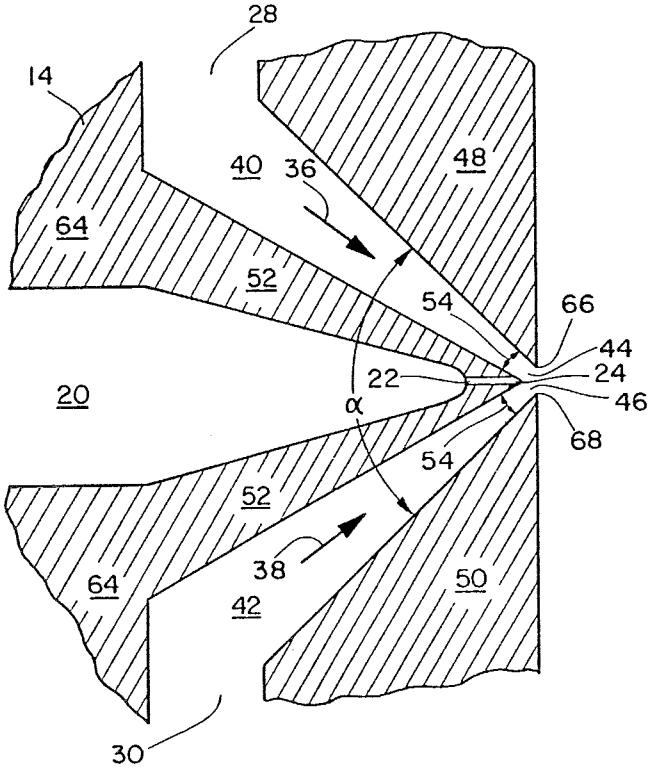
FIG. 3 is a schematic cross-sectional view, on a still more enlarged scale, of the die illustrated in FIG. 1, taken along line 2—2 of FIG. 2, illustrating the die in a recessed die tip arrangement.

FIGS. 3 and 4 best illustrate the melt-blowing die 14. An extrusion slot 20 receives the extrudable blend from the extruder 12. The extrudable blend then passes through the extrusion slot 20 and through a plurality of small diameter capillaries 22, which exit the die 14 in a linear arrangement, best illustrated in FIG. 2, extending across the tip 24 of the die 14, to emerge from the capillaries 22 as molten threads 26. Preferably, the extrudable blend is extrudable within the above-defined temperature ranges, through the small diameter capillaries, that is, within the die tip, at pressures as applied by the turning screw of the extruder 12, of no more than about 300 pounds per square inch, gauge. For example, useful pressures include those from about 20 pounds per square inch, gauge, to about 250 pounds per square inch, gauge, and more specifically, pressures of from about 50 pounds per square inch, gauge, to about 250 pounds per square inch, gauge, even more specifically from about 125 pounds per square inch, gauge, to about 225 pounds per square inch, gauge. Pressures in excess of 300 pounds per square inch, gauge may rupture or break some dies 14. Generally speaking, the extrudable blend is discharged through the capillaries 22 of the die 14 at a rate of from at least about 0.02 gram per capillary per minute to about 1.7 or more grams per capillary per minute, for example, from at least about 0.1 gram per capillary per minute to about 1.25 grams per capillary per minute, and more specifically, from at least about 0.3 gram per capillary per minute to about 1.1 grams per capillary per minute.

The die 14 also includes attenuating gas inlets 28 and 30 which are provided with heated, pressurized attenuating gas (not shown) by attenuating gas sources 32 and 34 (FIG. 1). The heated, pressurized attenuating gas enters the die 14 at the inlets 28 and 30 and follows the path generally designated by the arrows 36 and 38 in FIGS. 3 and 4 through two chambers 40 and 42 and on through to narrow passageways or gaps 44 and 46, respectively, so as to contact the extruded threads 26 (FIG. 1) as they exit the capillaries 22 of the die 14. The chambers 40 and 42 are designed so that the heated attenuating gas exits the chambers 40 and 42 and passes through the gas passages 44 and 46 to form a stream (not shown of attenuating gas which exits the die 14.

The temperature and pressure of the heated stream of attenuating gas can vary widely, depending on the particular equipment being used. For example, the heated attenuating gas can be applied at a temperature of from about 250° F. to about 500° F., more specifically, from about 280° F. to about 450° F., at a pressure of from about 0.5 pound per square inch, gauge, to about 20 pounds per square inch, gauge, more specifically, from about 1 pound per square inch, gauge, to about 10 pounds per square inch, gauge.

The position of air plates 48 and 50 which, in conjunction with a die tip portion 52 of the die 14, define the chambers 40 and 42 and the passageways 44 and 46, may be adjusted relative to the die tip portion 52 to widen or narrow the width 54 of the attenuating gas passageways 44 and 46 so that the volume of attenuating gas passing through the air passageways 44 and 46 during a given time period can be adjusted without varying the velocity of the attenuating gas. Furthermore, the air plates 48 and 50 can also be adjusted upwardly and downwardly to effect a "recessed" die tip configuration (FIG. 3) or a positive die tip "stick-out" configuration (FIG. 4) as discussed in detail below. Generally speaking, it is preferred to utilize attenuating gas pressures of less than about 20 pounds per square inch, gauge, in conjunction with air passageway widths, which are usually the same, of no greater than about 0.20 inch. Lower attenuating gas velocities and wider air passageway gaps are generally preferred if substantially continuous fibers or microfibers are to be produced.

The die tip 52 is formed at an angle preferably bisected by the capillaries 22. The air plates are arranged so that respective surfaces 48'-50' inside chambers 40 and 42 define an angle $\alpha$ preferably bisected by capillaries 22.

The two streams of attenuating gas converge to form a stream of gas which entrains and attenuates the molten threads 26, as they exit the linearly arranged capillaries 22 into fibers or, depending upon the degree of attenuation, microfibers 26 of a small diameter, to a diameter less than the diameter of the capillaries 22. The gas-borne fibers 26 are blown, by the action of the attenuating gas, onto a collecting arrangement which, in the embodiment illustrated in FIG. 1, is a foraminous endless belt 56 conventionally driven by rollers 57. Other foraminous arrangements such as a rotating drum arrangement may be utilized.

Figure 5:
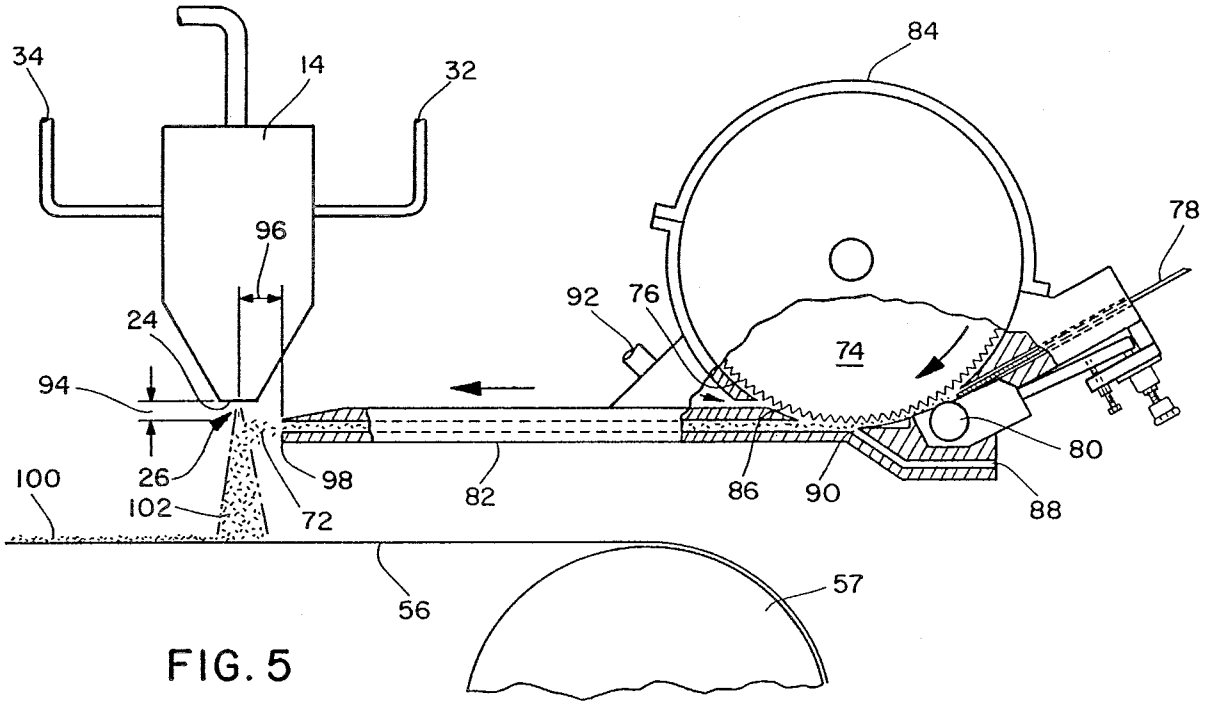
FIG. 5 is a schematic view with portions broken away for purposes of illustration of an arrangement which may be utilized to incorporate secondary fibers into the extruded threads of molten material prior to their formation into a nonwoven web.

FIG. 1 illustrates the formation of substantially continuous fibers 26 on the surface of the belt 56. However, the fibers 26 can be formed in a substantially discontinuous fashion as illustrated in FIG. 5 by adjusting the velocity of the attenuating gas, the temperature of the attenuating gas, and the volume of attenuating gas passing through the air passageways in a given time period.

The collecting arrangement may also include one or more vacuum boxes (not shown) located below the surface of the belt 56 and between the rollers 57. The fibers 26 are collected as a fibrous nonwoven elastomeric web 18 on the surface of the belt 56 which is travelling in the direction indicated by the arrow 58 in FIG. 1. The vacuum boxes assist in retention of the fibers 26 on the surface of the belt 56.

Typically the tip 24 of the die tip portion 52 of the melt-blowing die 14 is from about 4 inches to about 24 inches from the surface of the belt 56 upon which the fibers 26 are collected. The thus-collected, entangled fibers 26 form a coherent, fibrous nonwoven elastomeric web 18 which may be removed from the belt 56 by a pair of pinch rollers 60 and 62 (FIG. 1) which may be designed to press the entangled fibers of the web 18 together to improve the integrity of the web 18. Thereafter, the web 18 may be transported by a conventional arrangement to a windup roll (not shown) for storage. Alternatively, the web 18 may be removed directly from the belt 56 by the windup roller. The web 18 may be pattern-embossed as by ultrasonic embossing equipment (not shown) or other embossing equipment such as, for example, the pressure nip formed between a heated calendar and anvil roll (not shown).

Referring again to FIGS. 3 and 4, it can be seen that the melt-blowing die 14 includes a base portion 64 and a die tip portion 52 which generally centrally extends from the base portion 64. The centrally located die tip portion 52 is inwardly tapered to a "knife-edge" point which forms the tip 24 of the die tip portion 52 of the die 14. In order to increase the pressures of extrusion which the die 14 can withstand during operation, it is preferred for the base portion 64 and the die tip portion 52 to be formed from a single block of metal which surrounds the extrusion slot 20 and the extrusion capillaries 22. The die 14 also includes two air plates 48 and 50, discussed above, which are secured by conventional means to the base portion 64 of the die 14. The air plate 48, in conjunction with the die tip portion 52 of the die 14, defines the chamber 40 and the attenuating gas air passage or gap 44. The air plate 50, in conjunction with the die tip portion 52, defines the chamber 42 and the air passageway or gap 46. The air plates 48 and 50 terminate, respectively, in air plate lips 66 and 68.

In the configuration illustrated in FIG. 3, the knife-edge point which forms the tip 24 of the die tip portion 52 of the die 14 is recessed inwardly of the plan formed by the air plate lips 66 and 68. In this configuration the perpendicular distance between the plane formed by the lips 66 and 68 and the tip 24 of the die tip portion 52 is sometimes referred to by those in the art as a "negative stick-out" or a "recessed" die tip configuration. If the tip of the die tip portion 52 of the die 14 is configured to protrude outwardly beyond the plane formed by the lips 66 and 68 of the air plates 48 and 50, as is illustrated in FIG. 4, such a configuration is referred to by those in the art as a "positive stick-out" of the tip 24 of the die tip 52. In the examples discussed below, negative numbers are utilized with die tip 52 "stick-out" distances when the tip 24 of the die tip 52 is recessed with regard to the plane formed by the lips 66 and 68 of the air plates 48 and 50. If the tip 24 of the die tip 52 is configured so that it protrudes beyond the plane formed by the lips 66 and 68 of the air plates 48 and 50, the die tip "stick-out" distances are given in positive numbers. Positive and negative die tip "stick-out" values are obtained by measuring the perpendicular distance between the plane formed by the lips 66 and 68 of the air plates 48 and 50 and the knife-edge point which forms the tip 24 of the die tip portion 52 of the die 14, in other words, the closest distance between the point 24 and the plane formed by the lips 66 and 68, as defined above. It should also be noted that, unless otherwise stated, the term "air gap or width", as used herein, is the perpendicular, i.e., minimum, width 54 of either of the air passages 44 and 46. These widths are normally arranged to be identical.

FIG. 5 illustrates another embodiment of the present invention where one or more types of secondary fibers 72 are distributed within or upon the stream of fibers or microfibers 26. Distribution of the secondary fibers 72 within the stream of fibers 26 may be such that the secondary fibers 72 are generally uniformly distributed throughout the stream of fibers 26. This may be accomplished by merging a secondary gas stream (not shown) containing the secondary fibers 72 with the stream of fibers 26. Apparatus for accomplishing this merger may include a conventional picker roll 74 arrangement which has a plurality of teeth 76 that are adapted to separate a mat, sheet or batt of secondary fibers 78 into the individual secondary fibers 72. The mat, sheet or batt of secondary fibers 78 which is fed to the picker roll 74 may be of pulp fibers (if a two component mixture of fibers and secondary pulp fibers is desired), of staple fibers (if a two component mixture of fibers and secondary staple fibers is desired) or of both pulp fibers and staple fibers (if a three component mixture of polyether-ester fibers, secondary staple fibers and secondary pulp fibers is desired). In embodiments where, for example, absorbent or superabsorbent characteristics are desired, the secondary fibers 72 are absorbent or superabsorbent fibers. The secondary fibers 72 may generally be selected from the group including one or more polyester fibers, polyamide fibers, polyolefin fibers such as, for example, polyethylene fibers and polypropylene fibers, cellulosic derived fibers such as, for example, rayon fibers and wood pulp fibers, multi-component fibers such as, for example, sheath-core multi-component fibers or side-by-side multi-component fibers, natural fibers such as silk fibers, wool fibers or cotton fibers, electrically conductive fibers, absorbent fibers, superabsorbent fibers or blends of two or more of such secondary fibers. Other types of secondary fibers 72 as well as blends of two or more of other types of secondary fibers 72 may be utilized. The secondary fibers 72 may be microfibers or the secondary fibers 72 may be macrofibers having an average diameter of from about 300 microns to about 1,000 microns.

The sheets, batts or mats 78 of secondary fibers 72 are fed to the picker roll 74 by a roller arrangement 80. After the teeth 76 of the picker roll 74 have separated the mat, sheet or batt of secondary fibers 78 into separate secondary fibers 72 the individual secondary fibers 72 are conveyed toward the stream of fibers or microfibers 26 through a nozzle 82. A housing 84 encloses the picker roll 74 and provides a passageway or gap 86 between the housing 84 and the surface of the teeth 76 of the picker roll 74. A gas (not shown), for example air, is supplied to the passageway or gap 86 between the surface of the picker roll 74 and the housing 84 by way of a gas duct 88. The gas duct 88 may enter the passageway or gap 86 generally at the junction 90 of the nozzle 82 and the gap 86. The gas is supplied in sufficient quantity to serve as a medium for conveying the secondary fibers 72 through the nozzle 82. The gas supplied from the duct 88 also serves as an aid in removing the secondary fibers from the teeth 76 of the picker roll 74. However, gas supplied through the duct 92 generally provides for removal of the secondary fibers 72 from the teeth 76 of the picker roll 74. The gas may be supplied by any conventional arrangement such as, for example, an air blower (not shown).

Generally speaking, the individual secondary fibers 72 are conveyed through the nozzle 82 at about the velocity at which the secondary fibers 72 leave the teeth 76 of the picker roll 74. In other words, the secondary fibers 72, upon leaving the teeth 76 of the picker roll 74 and entering the nozzle 82, generally maintain their velocity in both magnitude and direction from the point where they left the teeth 76 of the picker roll 74. Such an arrangement, which is discussed in more detail in U.S. Pat. No. 4,100,324 to Anderson et al., hereby incorporated by reference, aids in substantially reducing fiber floccing.

As an aid in maintaining satisfactory secondary fiber 72 velocity, the nozzle 82 may be positioned so that its longitudinal axis is substantially parallel to a plane which is tangent to the picker roll 74 at the junction 90 of the nozzle 82 with the passageway 86. As a result of this configuration, the velocity of the secondary fibers 72 is not substantially changed because of contact of the secondary fibers 72 with the walls of the nozzle 82. If the secondary fibers 72 temporarily remain in contact with the teeth 76 of the picker roll 74 after they have been separated from the mat or batt 78, the axis of the nozzle 82 may be adjusted appropriately to be aligned with the direction of secondary fiber 72 velocity at the point where the secondary fibers 72 disengage from the teeth 76 of the picker roll 74. The disengagement of the secondary fibers 72 from the teeth 76 of the picker roll 74 may be assisted by application of a pressurized gas, i.e., air through duct 92.

The vertical distance 94 that the nozzle 82 is below the die tip 24 may be adjusted to vary the properties of the composite product 100. Variation of the horizontal distance 96 of the tip 98 of the nozzle 82 from the die tip 24 will also achieve variations in the final elastic composite product 100. The vertical distance 94 and the horizontal distance 96 values will also vary with the material being added to the fibers 26. The width of the nozzle 82 along the picker roll 74 and the length that the nozzle 82 extends from the picker roll 74 are also important is obtaining optimum distribution of the secondary fibers 72 throughout the stream of fibers 26. It is usually desirable for the length of the nozzle 82 to be as short as equipment design will allow. The length is usually limited to a minimum length which is generally equal to the radius of the picker roll 74. Usually, the width of the nozzle 82 should not exceed the width of the sheets, batts or mats 78 that are being fed to the picker roll 74.

The picker roll 74 may be replaced by a conventional particulate injection system to form a composite nonwoven web product 100 containing various secondary particulates. A combination of both secondary particulates and secondary fibers could be added to the fibers 26 prior to formation of the composite product 100 if a conventional particulate injection system was added to the left side of the system illustrated in FIG. 5.

FIG. 5 further illustrates that the gas stream carrying the secondary fibers 72 is moving in a direction which is generally perpendicular to the direction of movement of the stream of fibers 26 at the point of merger of the two streams. Other angles of merger of the two streams may be utilized. The velocity of the gas stream of secondary fibers 72 is usually adjusted so that it is less than the velocity of the stream of fibers 26. This allows the streams, upon merger and integration thereof to flow in substantially the same direction as that of the stream of fibers 26. Indeed, the merger of the two streams may be accomplished in a manner which is somewhat like an aspirating effect where the stream of secondary fibers 72 is drawn into the stream of fibers 26. If desired, the velocity difference between the two gas streams may be such that the secondary fibers 72 are integrated into the fibers 26 in a turbulent manner so that the secondary fibers 72 become substantially thoroughly and uniformly mixed throughout the fibers 26. Generally, for increased production rates, the gas stream which entrains and attenuates the stream of fibers 26 should have a comparatively high initial velocity, for example from about 200 feet to over 1,000 feet per second, and the stream of gas which carries the secondary fibers 72 should have a comparatively low initial velocity, for example from about 50 to about 200 feet per second. After the stream of gas that entrains and attenuates the fibers 26 exits the gaps 42 and 44 of the die 14, it immediately expands and decreases in velocity.

Upon merger and integration of the stream of secondary fibers 72 into the stream of fibers 26 to generally uniformly distribute the secondary fibers 72 throughout the stream of fibers 26, a composite stream 102 of fibers 26 and secondary fibers 72 is formed. If the fibers 26 are still semi-molten and tacky at the time of incorporation of the secondary fibers 72 into the fibers 26, the secondary fibers 72 are not only mechanically entangled within the coherent matrix formed by the fibers 26 but may also be thermally bonded or joined to the fibers 26.

In order to convert the composite stream 102 of fibers 26 and secondary fibers 72 into a composite elastic nonwoven web or mat 100 composed of a coherent matrix of the fibers 26 having the secondary fibers 72 generally uniformly distributed therein, a collecting device is located in the path of the composite stream 102. The collecting device may be the endless belt 56 of FIG. 1. The belt 56 is usually porous and a conventional vacuum arrangement (not shown) which assists in retaining the composite stream 102 on the external surface of the belt 56 is usually present. Other collecting devices are well known to those of skill in the art and may be utilized in place of the endless belt 56. For example, a porous rotating drum arrangement could be utilized. Thereafter, the composite elastic nonwoven web 88 is removed from the screen by the action of rollers (not shown) such as rollers 60 and 62 shown in FIG. 1.

In certain applications, particulate materials may be substituted for the secondary fibers 72. Alternatively, the elastic nonwoven web 88 may have both secondary fibers 64 and particulate materials incorporated into the coherent matrix of polyetherester fibers.

Depending on the characteristics desired of the coformed fibrous nonwoven elastomeric web, the web can include (1) from at least about 20% by weight of a fibrous nonwoven elastic web of microfibers as defined herein, and (2) from greater than 0% by weight to about 80% by weight of at least one secondary fiber generally uniformly distributed throughout the fibrous nonwoven elastomeric web.

The material from which the microfibers are formed may be any of the melt-blown materials contemplated by the present invention. Thus, the microfibers may be formed from copolymers of ethylene with vinyl acetate, acrylic acid, methacrylic acid, ethyl acrylate, methyl methacrylate, and mixtures of these. The microfibers may also be formed from blends of copolymer with modifying polymer, which preferably is one or more of the polyolefins within any one of the above-mentioned blend ranges. Additionally, the secondary fibers can form from about 30% by weight to about 70% by weight of the coformed web and even more specifically, the secondary fibers can form from about 50% by weight to about 70% by weight of the coformed web.

Throughout the specification and the various examples discussed herein, a variety of melt-blowing die extruders and configurations were utilized or contemplated for use in a variety of combinations to illustrate the broad applicability of the present invention. Specific details of melt-blowing dies that have been used or that are proposed for use are, for ease of reference, tabulated in Table II below:

TABLE II

MELT-BLOWING DIES

| Die No. | Extent of Capillary Array (in.) | Capillaries per Inch of Die Extent | Capillary Diameter (inches) | Capillary Length (inches) |
|---|---|---|---|---|
| #1 | 20 | 15 | 0.018 | 0.14 |
| #2 | 20 | 30 | 0.0145 | 0.113 |
| #3 | 1⅝ | 20 | 0.0145 | 0.133 |
| #4 | 1⅝ | 9 | 0.0145 | 0.133 |

Melt-blowing dies #3 and #4 are high pressure dies.

The description of the invention will now be further amplified by a description of several examples of the invention. In this description, all parts and percentages are by weight, and all temperatures are in degrees Celsius, unless expressly stated otherwise. Numerical values reported are values averaged from at least five separate readings, generally.

EXAMPLE 1

Production of Microfibers From a Copolymer of Ethylene and Vinyl Acetate

The apparatus employed is experimental equipment designed for screening and small-scale production. The EVA copolymer selected had a nominal melt index of 500 at 190° C. and contained 28% by weight of vinyl acetate.

The die was of Japanese Manufacture. The extruder was a Prodex extruder with three zones for which the temperature could be set and adjusted, and the actual temperature could be observed. The die head had 20 holes per inch. The diameter of the nose piece holes was 0.38 mm. The die head was supplied with hot air from a furnace. Air temperature measurement was possible at the furnace and also at different locations in the die head. The temperature of the die head could also be measured in several places.

Three different microfiber production runs A, B and C were made using substantially the same operating conditions. In all three runs, the die head was mounted to discharge toward the surface of a rotary drum. The drum surface was foraminous. In runs A and B, the collector speed, which is the linear velocity of the drum surface, was 10.5 feet per minute; in run C, the collector speed was 30 inches per minute.

In run A, the distance between the capillaries in the die head and the collector surface was 18.75 inches; in runs B and C, it was 11.75 inches. In all three runs, the equipment was operated so that the rate of operation, measured in pounds of resin consumed per linear transverse inch of die per hour was 1.09.

The settings on the equipment for these production runs were as follows. The three zones of the extruder, from its inlet end to its discharge end, were set at 320° F., 360° F., and 380° F., respectively (160° C., 182° C., and 193° C., respectively). Actual readings during operation were generally within 1° F. of the settings.

The screw in the extruder was operated at 39.3 rpm. Since frictional heat is generated during the extrusion process, the temperature of the resin as measured near the discharge end of the extruder was 404° F. (207° C.). The furnace for heating the attenuating air was set for 370° F. (188° C.), and in actual operation was observed to attain a temperature of 375° F. (191° C.). Because of heat losses, the temperature of the air in the die head was generally in the range from about 340° F. to about 348° F. (171° C. to 176° C.). The die temperature was set to be about 400° F. (204° C.), and in operation, this temperature was attained with very minor differences between different parts of the die head. The back pressure on the extruder during operation was about 245 psi.

The equipment was used under the conditions described to form microfibers from the EVA copolymer specifically identified in this Example. As the microfibers were discharged and during their path of travel to the collector surface, they were quenched with a light water spray that cooled the microfibers. As the microfibers collected, a cohesive nonwoven web was formed on the surface of the collector. The microfibers retained sufficient tack to become cohesive (self-bonded). The basis weight of the nonwoven web produced in run A was 3.0 grams per square yard.

In run B, where the difference from run A was in the setting of the distance from the die head to the collector surface at 11.75 inches, the basis weight was nominally 3.0 (2.98 actual) grams per square yard, and as measured was 2.76 grams per square yard. In run C, the die collector distance, i.e., the distance from the die head to the collector surface, remained the same as in run B at 11.75 inches, but the linear speed of the collector surface was adjusted to 30 inches per minute. The basis weight for the cohesive nonwoven web formed was a nominal 1.0 ounce per square yard, and as actually measured, was 1.1 ounces per square yard.

Other properties of these nonwoven webs were also determined, as reported in Table III below:

TABLE III

| Run | A | B | C |
|---|---|---|---|
| Bulk (inches) | 0.023 | 0.020 | 0.011 |
| Grab (lbs.) to break: | | | |
| Machine Direction | 1.9 | 2.4 | 0.67 |
| Cross/Machine Direction | 1.5 | 2.1 | 0.54 |
| Fiber Diameter (Micrometers) | 14.0 | — | 13.0 |

It was observed that the web was elastic and drapeable. Impact strength and stretch properties appeared to be good.

EXAMPLE 2

Production of Microfibers From a Different Copolymer of Ethylene and Vinyl Acetate Different equipment was used from that in Example 1, and under operating conditions as described below. The EVA copolymer employed had a melt index (nominal) of 200 at 190° C. and contained 28% by weight of vinyl acetate. The molten material could therefore be expected to be more viscous than the copolymer used in Example 1, and in fact, it was.

Another run was made, with several rolls of nonwoven web product being collected. The distance from the die head to the collector was set at 12 inches. The resin temperature adjacent the discharge end of the extruder was 366° F. (186° C.). During the run, this temperature fluctuated as high as 373° F., but generally was within a couple of degrees of 360° F. The primary air temperature was 477° F. (247° C.), and the air pressure was 2.64 psi. The air flow rate in standard cubic feet per minute was 27. The die inlet pressure was 160 psi. The screw of the extruder was driven at 72 rpm, somewhat higher than in Example 1.

The extruder had five permissible temperature settings. The settings during operation were: 250° F. (66° C.); 190° F. (88° C.); 300° F. (149° C.); 370° F. (188° C.); 400° F. (204° C.). The highest temperature was at the discharge end of the extruder. Toward the end of the run, the initial temperature settings were adjusted, without a significant change in the process or product.

In this run, the air was relied upon for quenching (cooling) the microfibers. However, with this higher viscosity material, quenching was not as necessary as with the relatively low viscosity material employed in Example 1.

The cohesive nonwoven web produced was taken off in two rolls. The characteristics are reported in Table IV below.

TABLE IV

| | A | B |
|---|---|---|
| Basis weight, oz./yd.$^2$ | 2.0 | 2.3 |
| Bulk, inches | 0.017 | 0.015 |
| Grab, lbs. | | |
| Machine Direction (MD) | 3.0 | 3.0 |
| Cross Direction (CD) | 2.2 | 2.1 |
| Tear, lbs. | | |
| MD | 0.94 | 0.84 |
| CD | 0.36 | 0.60 |
| Absorbency | | |
| $H_2O$, % | 115 | 104 |
| Oil, % | 334 | 258 |

Preweighed specimen pieces of each roll were tested for their respective abilities to absorb water and oil. The final entries in Table IV above report the percentages absorbed by these samples by weight of the original samples, respectively.

The data in this Example are actual data from actual production, but some of the values reported fluctuated during the course of the run.

EXAMPLE 3

Microfibers Made From Blends of a Copolymer of Ethylene With Vinyl Acetate and Linear Lower Density Polyethylene Several melt-blowing runs were made to produce microfibers from blends. In each case the blend used the same copolymer of ethylene and vinyl acetate, and the same linear low density (LLD) polyethylene; the proportions differed.

The particular copolymer of ethylene and vinyl acetate selected for this run had a nominal melt index of 200 at 190° C., and contained 28% by weight of vinyl acetate. The polyethylene was a linear low density polyethylene.

The runs reported in this Example were made in equipment generally similar to that shown in FIG. 1. There were six adjustable heat zones in the extruder. The term "melt temperature" refers to the temperature of the molten blend just before leaving the extruder. The "pipe temperature" refers to the temperature in the pipe that is shown in FIG. 1 connecting the discharge end of the extruder with the inlet manifold of the die head. The die head itself was provided with a heating element having an adjustable temperature setting. The term "die temperature" refers to the temperature of the molten blend or resin as measured within the die head prior to extrusion.

The available data on the several runs made are reported in Table V below.

TABLE V

| Run | A | B | C | D | E |
|---|---|---|---|---|---|
| | | Copolymer-LLD Polyethylene Runs | | | |
| Resin | Copolymer (Cop) | Cop/PE | Cop/PE | Cop/PE | Cop/PE |
| Proportions, (%) | 100 | 90/10 | 70/30 | 50/50 | 10/90 |
| | | Operating Conditions | | | |
| Extruder Temperature Setting, °F.(°C.) | | | | | |
| Zone 1 | 250(121) | 250(121) | 250(121) | 250(121) | 250(121) |
| Zone 2 | 350(177) | 350(177) | 350(177) | 350(177) | 350(177) |
| Zone 3 | 430(221) | 430(221) | 430(221) | 430(221) | 450(232) |
| Zone 4 | 430 | 430 | 430 | 450 | 450 |
| Zone 5 | 430 | 430 | 430 | 450 | 450 |
| Zone 6 | 430 | 430 | 430 | 450 | 450 |
| Melt Temperature, °F.(°C.) | | | | | |
| | 435(224) | 435(224) | 432(222) | 470(243) initial, 450(232) final | 451(233) |
| Pipe Temperature, °F.(°C.) | | | | | |
| | 430(221) | 430(221) | 430(221) | 470(243) initial, 450(232) final | 450(232) |
| Die Heating Zones Observed Temperature, °F.(°C.) | | | | | |
| | 430(221) | 430(221) | 430(221) | 470(243) initial, 450(232) final | 450(232) |
| Temperature in Die Head, °F.(°C.) | | | | | |
| | 371(188) | 381(194) | 387(197) | 422(217) | 420(216) initial, 411(211) final |
| Attenuating Air | | | | | |
| Temperature, °F.(°C.) | 358(181) | 370(188) | 390(199) | 440(227) | 418(214) |

TABLE V-continued

| Run | A | B | C | D | E |
|---|---|---|---|---|---|
| Flow Rate (SCF) | 290 | 370 | 350 | 350 initial, 380 final | 350 |
| Die Collector Distance, Inches | | | | | |
| | 11 initial, 13.5 final | 9 | 9 | 12 | 12 |
| | | Product Properties | | | |
| Basis Weight, oz./yd.$^2$ | | | 1.0 | 1.0 | 1.0 |
| P. Strain MD/CD, % | | | 76/178 | 71/130 | 132/191 |
| Frazier (ft$^3$/min/ft$^2$) | | | 157 | 426 | 434 |

During the operating runs, some of the equipment settings were adjusted as the operators sought to produce the best product possible. For all runs, the die tip was set back to −0.080 inch. The minimum die head opening was 0.080 inch. The effects of the presence of increasing amounts of polyethylene in the blends being melt-blown is shown by the generally higher processing temperatures required for higher polyethylene contents.

Webs produced from these microfibers had good hand, were soft, cloth-like, and tactically acceptable. The webs retained an elastomeric character and had good stretching properties.

EXAMPLE 4

Microfibers Made From Blends of a Copolymer of Ethylene With Vinyl Acetate and Polypropylene Microfibers were prepared by melt-blowing several different blends of a copolymer of ethylene and vinyl acetate with polypropylene. For process comparison purposes, a run was also made with the copolymer alone. Since its properties were already known, they were not observed and recorded.

The ethylene-vinyl acetate copolymer had a nominal melt index of 200 at 190° C., and contained 28% by weight of vinyl acetate. The polypropylene was a commercial product sold as Exxon PP 3145, having a nominal melt flow rate of 300.

The equipment used was generally similar to that used in Example 2. The production runs were each of an initial quantity of 100 pounds of resin. The rate of throughput through the die head was on the order of 1–2 pounds per inch per hour.

In brief summary, the operators were instructed to run with an extruder profile in the range from 350° F. to 420° F., a pipe temperature of about 420° F., a temperature in the die head of about 430° F., and an attenuating air temperature of about 400° F. The die collector distance was to be set from 12 inches to 15 inches.

The run data is summarized in Table VI below:

TABLE VI

| Run | A | B | C | D | E |
|---|---|---|---|---|---|
| | | Copolymer-Polypropylene Blends | | | |
| Resin | Copolymer (Cop) | Cop/PE | Cop/PE | Cop/PE | Cop/PE |
| Proportions, (%) | 100 | 95/5 | 80/20 | 60/40 | 40/60 |
| | | Operating Conditions | | | |
| Extruder Temperature, °F. | | | | | |

TABLE VI-continued

| Run | A | B | C | D | E |
|---|---|---|---|---|---|
| Zone 1 | 250 | 250 | 250 | 250 | 250 |
| Zone 2 | | | 350 | 350 | 350 |
| Zone 3 | 350 | 350 | 440 | 440 | 440 |
| Zone 4 | | | 440 | 440 | 440 |
| Zone 5 | 390 | 400 initial, 390 final | 440 | 440 | 440 |
| Melt Temperature, °F. | | | | | |
| | 394 | 410 | 444 | 444 | 444 |
| Pipe Temperature, °F. | | | | | |
| | 390 | 400 | 440 | 440 | 440 |
| Die Zones Temperature, °F. | | | | | |
| | 390 | 400 | 445 | 445 | 440 |
| Die Temperature, °F. | | | | | |
| | 397 | 413 | 426 | 426 | 423 |
| Attenuating Air | | | | | |
| Temperature, °F.(°C.) | 300 | 420 | 450 | 450 | 450 |
| Flow Rate (SCFM) | 395 | 370 | 375 | 375 | 335 |
| Die Collector Distance, Inches | | | | | |
| | 12 | 12 | 12 | 12 | 10.5 initial, 12 final |
| | | Product Properties | | | |
| P. Strain MD/CD, % | | | 45/91 | 50/97 | |
| Frazier ($ft^3$/min/$ft^2$) | | | 216 | 255 | |

The nonwoven web products produced in these runs had highly desirable tactile properties. The hand was good, and the web was strong. The "Frazier" tests reported in this Example and in the previous Example reflect permeability and suitability for use in certain applications such as, for example, filtration, liquid-solid separation devices, and the like. The polypropylene content imparts toughness and resistance to flexing fatigue, while the copolymer content of ethylene-vinyl acetate copolymer imparts smoothness, softness, and toughness.

EXAMPLE 5

Nonwoven Webs Produced From Microfibers of Ethylene-Vinyl Acetate Copolymer Blended with Polypropylene and Polyethylene In these test runs of making melt-blown fibers from three-component blends, the copolymer of ethylene and vinyl acetate used was a commercially available product sold by Exxon Chemical Company under the trademark and grade designation, M-11948-077-004. This resin had a nominal melt index of 200 at 190° C., and an actual melt index of about 160. Its density was 0.950 grams per cubic centimeter, and the vinyl acetate content was 28.0% by weight.

The polypropylene was also a product of Exxon Chemical Company, sold under the designation, Polypropylene 3145. It had a density of about 0.910 grams per cubic centimeter when measured in accordance with ASTM D 792. It had a melt flow rate obtained in accordance with ASTM D 1238, Condition L, of about 300 grams per 10 minutes, a number average molecular weight (Mn) of about 43,580, a weight average molecular weight (Mw) of about 124,400, a Z average molecular weight (Mz) of about 255,600, and a polydispersity (Mw/Mn) of about 2.85.

The polyethylene employed was a linear low-density polyethylene obtained from the Exxon Chemical Company under the designation, LPX 61. It had a density of about 0.930 grams per cubic centimeter when measured in accordance with ASTM D 1505. It had a melt index of 105 at 190° C. in accordance with ASTM 1238. The number average molecular weight (Mn) was about 10,500, the weight average molecular weight (Mw) about 30,500, the Z average molecular weight (Mz) about 62,000, and the polydispersity (Mw/Mn) about 2.9.

Each of these three resins imparts its own peculiar properties to microfibers made from a blend. All three blends tested in these three runs produced homogeneous microfibers, indicating that the three resins were compatible.

In the tabular summary in Table VII below, polypropylene is identified by the abbreviation "PP"; polyethylene by the designation "PE", and the copolymer of ethylene and vinyl acetate by the designation "EVA". The proportions are by resin weight. In each case, they represent pellets of the respective resins placed in the hopper of apparatus similar to that shown in FIG. 1 of the drawings, after being dry blended. The equipment used in producing the microfibers was similar to that used in Example 2.

TABLE VII

| Resin | A | B | C |
|---|---|---|---|
| | Microfibers From a Blend of Polypropylene, Polyethylene, and an Ethylene-Vinyl Acetate | | |
| Proportions PE/ by Weight | 10 PP/10 PE/ 80 EVA | 15 PP/15 PE/ 70 EVA | 10 PP/30 60 EVA |
| | Operating Conditions | | |
| Extruder Temp. Settings, °F. | | | |
| Zone 1 | 252 | 251 | 251 |
| Zone 2 | 296 | 296 | 295 |
| Zone 3 | 434 | 433 | 434 |
| Zone 4 | 457 | 457 | 456 |
| Zone 5 | 452 | 452 | 451 |
| Zone 6 | 451 | 450 | 450 |
| Screw Speed, rpm | 35 | 35 | 35 |
| Melt Pressure, psi | 920 | 920 | 890 |
| Melt Temperature, °F. | 455 | 454 | 453 |
| Die Head | | | |
| Pressure, psi | 132 | 137 | 126 |
| Tip Temp, °F. | 375 | 384 | 387 |
| Attenuating Air | | | |
| Pressure, psi | 3 | 3 | 2.9–3 |
| Temperature, °F. | 340–349 | 356–366 | 384–395 |
| Flow, SCFM | 302 | 287 | 303 |
| Die Collector | | | |
| Distance, inches | 9½ | 9½ | 9½ |
| Speed, ft/min. | 32 | 15 | 32 |
| | Properties of the Nonwoven Web | | |
| Basis Weight, oz./$yd^2$ | 2.5 | 2.7 | 2.7 |
| P. Load, MD/CD, psi | 5.8/3.8 | 6.8/3.4 | 6.5/4.3 |
| P. Strain, MD/CD, % | 116/525 | 80/123 | 103/362 |
| Frazier, $ft.^3$/min./$ft^2$ | 231 | 232 | 164 |
| Absorbency, % | | | |
| $H_2O$ | 101 | 104 | 84 |
| Oil | 361 | 334 | 353 |

All three nonwoven webs produced by the three different fiber blends had properties somewhat different from each other. All were tactically acceptable, soft and cloth-like. All had strength and stretch properties that were quite acceptable. The webs had tactile characteristics resembling those of polypropylene or polyethylene, but each of these nonwoven webs had recoverable stretch characteristics.

It is contemplated that nonwoven webs of still different but desirable characteristics be made from blends of (A) copolymers of ethylene with (1) ethyl ethacrylate, (2) methyl ethacrylate, and (3) ethyl methacrylate, with (B) polyolefins including (1) LLD polyethylene, (2) polypropylene, and (3) mixtures of polyethylene and polypropylene.

In Table VII above, the two entries for the temperature of the attenuating air are those of the two plenum chambers respectively.

EXAMPLE 6

Coformed Microfibers and Nonwoven Webs; Copolymer of Ethylene with Vinyl Acetate, and Wood Pulp Fiber The ethylene-vinyl acetate used in this Example, in the following demonstrations of the invention, was purchased from Exxon Chemical Company at a nominal melt index of 200 at 190° C. and containing 28% by weight of vinyl acetate.

A fibrous, nonwoven elastic coformed web was formed by utilizing the techniques illustrated in FIG. 5 to combine wood pulp fibers with melt-blown fibers formed from the copolymer of ethylene and vinyl acetate.

Melt-Blowing

Melt-blowing of the copolymer was accomplished by extruding the copolymer from a one and one-half inch Johnson extruder and through a melt-blowing die having 15 extrusion capillaries per linear inch of die tip. That is, melt-blowing system A1, as defined above, was utilized.

The capillaries in the die head each had a diameter of about 0.018 inch and a length of about 0.14 inch. The copolymer was extruded through the capillaries at a rate of about 1.8 grams per capillary per minute under the operating conditions that are summarized in Table VIII below.

In this Table, the extrusion pressure exerted upon the copolymer in the die tip is reported as the "die pressure". The die tip configuration was adjusted so that it was recessed about 0.090 (−0.090 die tip stick-out) inch from the plane of the external surfaces of the lips of the air plates that form the attenuating air passageways on either side of the row of capillaries. The air plates were adjusted so that the two attenuating air passages, one on each side of the extrusion capillaries, formed passageways having air gaps, i.e., widths, of about 0.067 inch. It should be noted that the air passageway or gap configuration utilized in this Example differed slightly from the configuration that is illustrated in FIG. 3 in that the angle formed by the die tip portion 52, that is, the angle which the capillaries 22 bisect is 90°, and the angle is less than 90°, and therefore, the air gaps 44 and 46 are wider near the tip 24 of the die tip 52 than at the areas 40 and 42. In other words, the air gaps 44 and 46 of this die configuration, widen as opposed to narrow, as the attenuating air progresses (as indicated by the arrows 36 and 38).

Forming air for melt-blowing the copolymer supplied to the air passageways at the temperatures reported as "manifold temperature" in the Table below, and at a pressure of about 4 psig. The melt-blown fibers thus formed were blown to a forming screen that was approximately 12 inches from the die tip.

Coforming

Utilizing the conventional coforming techniques illustrated in FIG. 5, dry wood pulp fibers having lengths of ¼ inch to ½ inch were incorporated into the stream of melt-blown microfibers prior to the deposition of these microfibers upon the forming screen.

The wood pulp fibers were fed to a picker roll rotating at a rate of about 3,000 rpm, and fiber transporting air was supplied to the picker roll at a pressure of about 6 psig. The distance between the nozzle of the coforming apparatus and the streams of melt-blown fibers was not actually measured, but is believed to have been about two inches below the die tip of the melt-blowing die, and about two inches back from the die tip of the melt-blowing die.

Web Formation

This procedure provided a fibrous, nonwoven elastomeric web having a width in the cross-machine direction of about 20 inches. The web was composed of a blend having the composition indicated in Table VIII below for the two respective runs.

TABLE VIII

Coforming Microfibers From a Copolymer of Ethylene With Vinyl Acetate and Wood Pulp Fibers

| Run | A | B |
|---|---|---|
| Components, Wt. % | | |
| Copolymer | 90 | 50 |
| Wood Pulp Fiber | 10 | 50 |
| Operating Conditions | | |
| Extruder Temp. Settings, °F. | | |
| Zone 1 | 351 | 360 |
| Zone 2 | 431 | 457 |
| Zone 3 | 433 | 451 |
| Zone 4 | 434 | 458 |
| Zone 5 | 441 | 458 |
| Die Pressure, psig | 201 | 163 |
| Attenuating Air | | |
| Temperature, °F. | 392 | 470 |
| Pressure, psig | 3.5 | 3.5 |
| Picker Air Pressure, psig | 6 | 6 |

The cohesive, nonwoven coformed fibrous webs produced in these runs were characterized by very high absorbency for both oil and water, compared to copolymer webs in which wood pulp fiber was not incorporated. In addition, the wood pulp fiber is an extremely inexpensive material at present, so that good web properties were attained at relatively low cost. The webs had good hand. The web produced from run A had good tactile characteristics. The web produced from run B had a somewhat rough feel because of the relatively large amount of wood pulp fibers. Both webs were elastic and exhibited good recovery properties after being stretched. Both webs were therefore good candidates for the intercalary layer in a three-layer laminate, where the two outer layers were selected for strength and abrasion resistance, for example. Examples of such outer layers might be spun-bonded polyethylene and spun-bonded polypropylene, or spun-bonded fibers from mixtures of these two polyolefins, or a random copolymer of both.

EXAMPLE 7

Microfibers and Nonwoven Cohesive Elastomeric Webs Made From Ethylene-Vinyl Acetate Copolymer Using the techniques generally described in Example 1, three additional runs were made to make microfibers and nonwoven cohesive elastomeric webs from ethylene-vinyl acetate copolymer. This particular copolymer was purchased from Exxon Chemical Company, under the designation LD-763. It had a nominal melt index at 190° C. of 50, and contained 28% by weight of vinyl acetate.

The basic weights for the three webs from the three different runs, in ounces per square yard, were, respectively, 3.4, 0.98 and 3.4. Other web properties are summarized in Table IX below, along with the properties of a web made from a somewhat different copolymer having a nominal melt index at 190° C. of 160, and containing 28% by weight of vinyl acetate. The web produced from this copolymer had a basis weight of 2.5 ounces per square yard.

TABLE IX

| | Microfibers and Webs from Copolymer | | | |
|---|---|---|---|---|
| Run | A | B | C | D |
| Copolymer | | | | |
| Nominal M.I. | 50 | 50 | 50 | 160 |
| % VA | 28 | 28 | 28 | 28 |
| Web, Basic Wt., oz/yd.$^2$ | 3.4 | 2.98 | 3.4 | 2.5 |
| P. Load, MD/CD, lb. | 5.4/4.1 | 1.8/1.3 | 5.3/3.5 | 4.0/3.2 |
| T. Tear, MD/CD, lbs. | 0.66/ 0.53 | 0.58/ 0.69 | 0.93/ 0.92 | 0.87/ 0.67 |
| P. Strain MD/CD, % | 328/423 | 432/553 | 381/463 | 275/332 |
| Frazier, ft$^3$/min/ft$^2$ | 524 | 1080 | 405 | 372 |
| Absorbency, % | | | | |
| $H_2O$ | 107 | 241 | 141 | 133 |
| Oil | 319 | 363 | 288 | 377 |
| Fiber Diameter, | — | — | 16.7 | 12.7 |

In each case, the webs had good hand and, as the data indicates, good elasticity and absorbency. Since viscosity of the molten material decreases as the melt index increases, run D could be operated at lower extrusion pressures that runs A, B and C.

The nonwoven elastomeric fibers, microfibers and webs of the present invention find widespread application in providing elasticized fabrics and fabric components. The webs may be used by themselves, or they may be bonded to other materials. Potential uses include disposable garments and articles, by which is meant garments and articles designed to be discarded after one or a few uses rather than being repeatedly laundered and reused.

Nonwoven webs made in accordance with the present invention are useful per se as wiping cloths because of their good absorbency. This is particularly the case with coformed webs where the secondary fiber is wood pulp fiber.

While the invention has been disclosed in this patent application by reference to the details of preferred embodiments of the invention, it is to be understood that this disclosure is intended in an illustrative rather than in a limiting sense, as it is contemplated that modifications will readily occur to those skilled in the art, within the spirit of the invention and the scope of the appended claims.

What is claimed is:

1. A composite elastomeric web comprising:

meltblown elastomeric fibers formed from a copolymer of ethylene and at least one vinyl monomer selected from the group including vinyl ester monomers wherein said vinyl monomer comprises from about 10% to about 50%, by weight, of said copolymer; and at least one type of secondary fiber uniformly distributed throughout said web.

2. A composite elastomeric web comprising:

meltblown elastomeric fibers formed from a composition comprising a copolymer selected from the group consisting of ethylene vinyl acetate copolymer, ethylene-ethyl acrylate copolymer, ethylene-methylacrylate copolymer and ethylene-methylmethacrylate copolymer wherein said copolymer is comprised of from about 10% to about 50%, by weight, of nonethylene monomer; and at least one type of secondary fiber uniformly distributed throughout said web.

3. A composition fibrous nonwoven elastomeric web comprising:

elastomeric meltblown fibers formed from an ethylene-vinyl acetate copolymer comprised of from about 10% to about 50%, by weight, of vinyl acetate monomer, said copolymer having a melt index in the range of from about 32 to about 500 grams per ten minutes; and from greater than 0% by weight to about 80% by weight of at least one type of secondary fiber.

4. The composite elastomeric web of claim 1, wherein said elastomeric fibers are microfibers.

5. The composite elastomeric web of claim 2, wherein said elastomeric fibers are microfibers.

6. The composite elastomeric web of claim 3, wherein said elastomeric fibers are microfibers.

7. The composite elastomeric web of claim 3, wherein said secondary fiber comprises from about 30% by weight to about 70% by weight of said elastomeric web.

8. The composite elastomeric web of claim 3, wherein said secondary fiber comprises polyolefin fibers.

9. The composite elastomeric web of claim 3, wherein said secondary fiber is selected from the group consisting of wood pulp fiber, staple natural fiber, staple artificial fiber, and mixtures thereof.

10. The composite elastomeric web of claim 3, wherein said ethylene-vinyl acetate copolymer comprises from about 18% by weight to about 36% by weight of vinyl acetate monomer.

11. The composite elastomeric web of claim 3, wherein said ethylene-vinyl acetate copolymer comprises from about 26% by weight to about 30% by weight of vinyl acetate monomer.

12. The composite elastomeric web of claim 3, wherein said ethylene-vinyl acetate copolymer comprises about 28% by weight of vinyl acetate monomer.

13. A composite elastomeric web comprising:

(a) meltblown elastomeric fibers formed from a blend of:

(i) at least about 10% by weight of a copolymer of ethylene and at least one vinyl monomer selected from the group including vinyl ester monomers wherein said vinyl monomer comprises from about 10% to about 50%, by weight, of said copolymer; and (ii) from greater than 0% by weight to about 90% by weight of at least one compatible modifying polymer; and (b) at least one type of secondary fiber uniformly distributed throughout said web.

14. A composite elastomeric web comprising:

(a) meltblown elastomeric fibers formed from a blend of:

(i) at least about 10% by weight of a copolymer selected from the group consisting of ethylene vinyl acetate copolymer, ethylene-ethyl acrylate copolymer, ethylene-methylacrylate copolymer and ethylene-methylmethacrylate copolymer wherein said copolymer is comprised of from about 10% to about 50%, by weight, of nonethylene monomer; and (ii) from greater than 0% by weight to about 90% by weight of at least one compatible modifying polymer; and (b) at least one type of secondary fiber uniformly distributed throughout said web.

15. A composite elastomeric web comprising:

(a) meltblown elastomeric fibers formed from a blend of:

(i) at least about 10% by weight of an ethylene vinyl acetate copolymer comprised of from about 10% to about 50%, by weight, of vinyl acetate monomer, said copolymer having a melt index of from about 32 to about 500 grams per ten minutes; and (ii) from greater than 0% by weight to about 90% by weight of at least one compatible modifying polymer, and (b) at least one type of secondary fiber uniformly distributed throughout said web.

16. The composite elastomeric web of claim 15, wherein said ethylene vinyl acetate copolymer has a melt index of from about 50 to about 200 grams per ten minutes.

17. The composite elastomeric web of claim 12, wherein said modifying polymer is at least one polymer selected from the group including polyethylene, polypropylene, polybutene, ethylene copolymers, propylene copolymers and butene copolymers.

18. The composite elastomeric web of claim 12, wherein said modifying polymer is at least one ABA′ block copolymer, where A and A′ are each a thermoplastic polymer endblock that includes a styrenic moiety and where B is an elastomeric poly(ethylene-butene) midblock.

19. The composite elastomeric web of claim 12, wherein said secondary fiber is present in an amount of from greater than 0% by weight to about 80% by weight of the weight of said web.

20. The composite elastomeric web of claim 12, wherein said secondary fiber is present in an amount of from about 30% by weight to about 70% by weight of said web.

21. The composite elastomeric web of claim 12, wherein said secondary fiber is present in an amount of from about 50% by weight to about 70% by weight of said web.

22. The composite elastomeric web of claim 12, wherein said secondary fiber is selected from the group consisting of wood pulp fiber, staple natural fiber, staple artificial fiber, and mixtures thereof.

* * * * *

UNITED STATES PATENT AND TRADEMARK OFFICE
CERTIFICATE OF CORRECTION

PATENT NO. : 4,803,117
DATED : February 7, 1989
INVENTOR(S) : Diego H. Daponte It is certified that error appears in the above—identified patent and that said Letters Patent is hereby corrected as shown below:

In Column 28, line 23, please delete the word "composition" and insert -- composite --.

Signed and Sealed this
Twelfth Day of December, 1989

*Attest:*

JEFFREY M. SAMUELS

*Attesting Officer*

*Acting Commissioner of Patents and Trademarks*